US009428960B2

(12) United States Patent
Lanzl et al.

(10) Patent No.: US 9,428,960 B2
(45) Date of Patent: Aug. 30, 2016

(54) DRILLING UNIT

(75) Inventors: Martin Lanzl, Schrobenhausen (DE); Manfred Angermeier, Karlskron (DE); Peter Fischer, Kaisheim (DE); Dieter Stetter, Aichach (DE)

(73) Assignee: BAUER MASCHINEN GMBH, Schrobenhausen (DE)

( * ) Notice: Subject to any disclaimer, the term of this patent is extended or adjusted under 35 U.S.C. 154(b) by 654 days.

(21) Appl. No.: 13/537,916

(22) Filed: Jun. 29, 2012

(65) Prior Publication Data

US 2013/0000988 A1 Jan. 3, 2013

(30) Foreign Application Priority Data

Jun. 30, 2011 (EP) ..... 11005366

(51) Int. Cl.
*E21B 7/02* (2006.01)

(52) U.S. Cl.
CPC ..... *E21B 7/02* (2013.01)

(58) Field of Classification Search
CPC ..... E21B 7/02; E21B 7/022; E21B 7/023; E21B 15/00
See application file for complete search history.

(56) References Cited

U.S. PATENT DOCUMENTS

| | | | | |
|---|---|---|---|---|
| 3,910,358 | A * | 10/1975 | Martinek | E21B 44/06 173/152 |
| 4,148,367 | A * | 4/1979 | Reich | E21B 7/005 173/215 |
| 5,524,716 | A * | 6/1996 | Wachholz | 175/52 |
| 6,293,359 | B1 | 9/2001 | Dobran et al. | |
| 2009/0314547 | A1* | 12/2009 | Stoetzer et al. | 175/57 |

FOREIGN PATENT DOCUMENTS

| | | | |
|---|---|---|---|
| CN | 2878667 | Y | 3/2007 |
| CN | 101725589 | A | 6/2010 |
| DE | 9016037 | U1 | 3/1992 |
| DE | 10206646 | C1 | 7/2003 |
| EP | 0525186 | A1 | 2/1993 |
| EP | 2339108 | A1 | 6/2011 |
| RU | 2333335 | C2 | 9/2008 |
| RU | 91346 | U1 | 2/2010 |
| SU | 1715977 | A1 | 2/1992 |
| WO | 2011057493 | A1 | 5/2011 |

OTHER PUBLICATIONS

European Search Report; EP11005366; Dec. 14, 2011.

The English language translation of Search Report issued by the Chinese Patent Office on Jan. 27, 2014, which corresponds to Chinese Patent Application No. 201210220373.0 and is related to U.S. Appl. No. 13/537,916.

The English language translation of Office Action; "Decision of Granting," issued by the Russian Patent Office on Jan. 15, 2014, which corresponds to Russian Patent Application No. 2012123455/03(035694) and is related to U.S. Appl. No. 13/537,916.

* cited by examiner

*Primary Examiner* — Nicole Coy
*Assistant Examiner* — Kristyn Hall
(74) *Attorney, Agent, or Firm* — Studebaker & Brackett PC

(57) ABSTRACT

The invention relates to a drilling unit with a carrier vehicle with a hydraulic supply, a mast, a carriage which can be moved along the mast and a hydraulic cylinder for moving the carriage which comprises a cylinder housing, in which a piston with a piston rod is mounted so that it can be displaced. The piston rod is fixed to the mast and the cylinder housing to the carriage. The carriage is connected to the hydraulic supply and comprises at least one hydraulic connection. The hydraulic cylinder is connected via the hydraulic connection on the carriage to the hydraulic supply.

6 Claims, 3 Drawing Sheets

DRILLING UNIT

FIELD OF THE INVENTION

The invention relates to a drilling unit, in particular for creating boreholes in the ground, according to the preamble of claim 1.

Such a drilling unit comprises a carrier vehicle with a hydraulic supply, a mast, a carriage which can be moved along the mast and a hydraulic cylinder for moving the carriage which comprises a cylinder housing, in which a piston with a piston rod is mounted so that it can be displaced.

DESCRIPTION OF RELATED ART

It is usual with hydraulic cylinders to arrange the cylinder housing on the stationary side and the piston rod on the movable side as the hydraulic connection of a hydraulic cylinder is on the cylinder housing and as far as possible is not to be moved. A simple and maintenance-friendly connection of the hydraulic cylinder to a hydraulic supply is thus guaranteed.

In order to move a drilling carriage along the mast of a drilling unit it is thus known to fix the cylinder housing to the mast which constitutes a stationary base as opposed to the carriage which is mounted so that it can be moved thereon. Accordingly the piston rod of the hydraulic cylinder is fixed to the carriage in known drilling units.

SUMMARY OF THE INVENTION

It is the object of the invention to indicate a drilling unit with a constructively simple carriage drive which can be operated particularly economically.

The object is achieved according to the invention through a drilling unit with the features of claim 1. Preferred embodiments of the invention are indicated in the dependent claims.

The drilling unit according to the invention is characterised in that the piston rod is fixed to the mast and the cylinder housing to the carriage, the carriage is connected to the hydraulic supply and comprises at least one hydraulic connection and the hydraulic cylinder is connected via the hydraulic connection on the carriage to the hydraulic supply.

According to a first basic idea of the invention the hydraulic cylinder is incorporated in such a way that the cylinder housing is arranged on the carriage and thus moves together with the carriage in relation to the mast. If the mast is upright the hydraulic cylinder is usually arranged above the carriage in order to push the carriage downwards in drilling operation. Therefore, the centre of gravity of the drilling unit is moved downwards through the cylinder housing arranged below. Indeed the cylinder housing usually has a greater weight than the piston with the piston rod mounted therein. The incorporation direction of the hydraulic cylinder according to the invention thus leads to improved stability of the drilling unit.

A second basic idea of the invention can be seen in that the hydraulic cylinder is connected via the carriage to the central hydraulic supply of the drilling unit, said hydraulic supply usually being arranged on the carrier vehicle. The supply of the hydraulic cylinder with hydraulic fluid, in particular hydraulic oil, has the advantage that no relative movements take place between the cylinder housing and the carriage. A simple laying of a line between the carriage and one or optionally more inlet nozzles on the cylinder housing is thus possible.

According to the invention at least one hydraulic connection is present on the carriage, via which hydraulic fluid can be fed to the hydraulic cylinder. The hydraulic connection is for its part connected to a central hydraulic supply. The hydraulic connection which can for example comprise a coupling means for coupling a hydraulic line is fixedly arranged on the carriage and moves together with it. The hydraulic connection can for example be arranged on a retaining means fixed to the carriage such as a retaining plate.

According to a preferred embodiment of the invention at least one distribution means is provided for distributing hydraulic fluid. The distribution means is preferably connected via a central supply line and a central return line to the hydraulic supply. Through the distribution means the hydraulic fluid supplied by the central hydraulic supply can be distributed to a plurality of consumers. In addition hydraulic fluid travelling back can be collected at the distribution means and fed to the central return line. The central distribution means thus allows a plurality of consumers to be supplied with hydraulic fluid in the region of the carriage.

In order to supply further consumers, in particular a drive motor on the carriage, it is preferred for the distribution means to comprise one or further hydraulic connections. The drive motor on the carriage can for example be a hydraulic rotary drive for a drill rod assembly or also a hydraulic vibrator drive. By means of the distribution means therefore both the hydraulic cylinder and the drive motor on the carriage can be supplied with hydraulic fluid from the central hydraulic supply.

The distribution means for distributing hydraulic fluid to the hydraulic cylinder and one or more further consumers is preferably fixedly arranged on the carriage and moves together with it. The hydraulic connection for the hydraulic cylinder and the at least one further hydraulic connection are preferably arranged on the distribution means. Through the distribution means hydraulic fluid is thus preferably distributed to a plurality of hydraulic connections.

Alternatively or additionally it is possible for at least one distribution means to be arranged on the mast. The distribution means on the mast allows a simple laying of a line between the central hydraulic supply and the distribution means, as the position of the distribution means on the mast is independent of a carriage movement along the mast. The distribution means is preferably fixedly arranged on the mast.

In principle the hydraulic cylinder for moving the carriage can be a single acting cylinder, wherein the cylinder housing is moved relative to the piston rod by supplying hydraulic fluid and moves the carriage in the direction of the borehole to be created, preferably downwards. For particularly efficient production of a borehole, however, it is preferable for the hydraulic cylinder to be a double acting cylinder with two cylinder chambers and for two hydraulic connections to be provided on the carriage, wherein a first cylinder chamber of the hydraulic cylinder is line-connected to a first hydraulic connection and a second cylinder chamber is line-connected to a second hydraulic connection. For example the first hydraulic connection can be connected to a lower cylinder chamber of the hydraulic cylinder and the second hydraulic connection to an upper cylinder chamber of the hydraulic cylinder. Through the supply of hydraulic fluid to the first hydraulic connection the cylinder housing can be moved out relative to the piston and correspondingly moved in through the supply of hydraulic fluid to the second hydraulic connection.

An advantageous supply of the hydraulic cylinder with hydraulic fluid is achieved in that at least one hydraulic line is arranged between the hydraulic connection and the hydraulic cylinder, said hydraulic line extending from the hydraulic connection upwards along the mast. The supply of the hydraulic cylinder with hydraulic fluid thus takes place on an extensively direct path from the carriage to the corresponding connection nozzle on the cylinder housing. The whole line can preferably be moved between the hydraulic connection on the carriage and connection nozzle on the hydraulic cylinder relative to the mast. A supply via the mast requiring comparatively high resources is not therefore necessary.

A particularly robust carriage drive can be achieved in that a fixed pipeline is provided between the hydraulic connection on the carriage and the hydraulic cylinder. A fixed pipeline is hereby to be understood to be in particular an extensively dimensionally stable or rigid line. The line can be made of metal for example but also from a correspondingly solid plastic. The line between the hydraulic connection and the connection nozzle is preferably fixed to the cylinder housing with at least one fixing means.

An advantageous connection of the hydraulic cylinder to the second hydraulic supply can be achieved in that at least one central supply line is arranged between the hydraulic connection and the hydraulic supply, said central supply line being fixed to a retaining element on the mast. As the mast itself usually only moves very slightly during drilling operation relative to the carrier vehicle, in particular the upper structure, secure laying of a line can take place through the retaining element fixed to the mast. A flexible line is thus necessary essentially merely in a section between the retaining element on the mast and the hydraulic connection provided on the carriage.

The flexible line section between the retaining element and hydraulic connection can thereby be kept particularly short in that the retaining element is arranged centrally on the mast having regard to the cylinder housing of the hydraulic cylinder. A flexible line section can also extend between the mast and carrier vehicle. The retaining element is arranged in particular half way along the movement path of the carriage along the mast.

BRIEF DESCRIPTION OF THE DRAWINGS

The invention is described further below by reference to a preferred embodiment which is schematically shown in the attached drawing, in which.

Corresponding components are identified in all the drawings with the same reference numerals.

DETAILED DESCRIPTION OF THE PREFERRED EMBODIMENT

Figure 1:
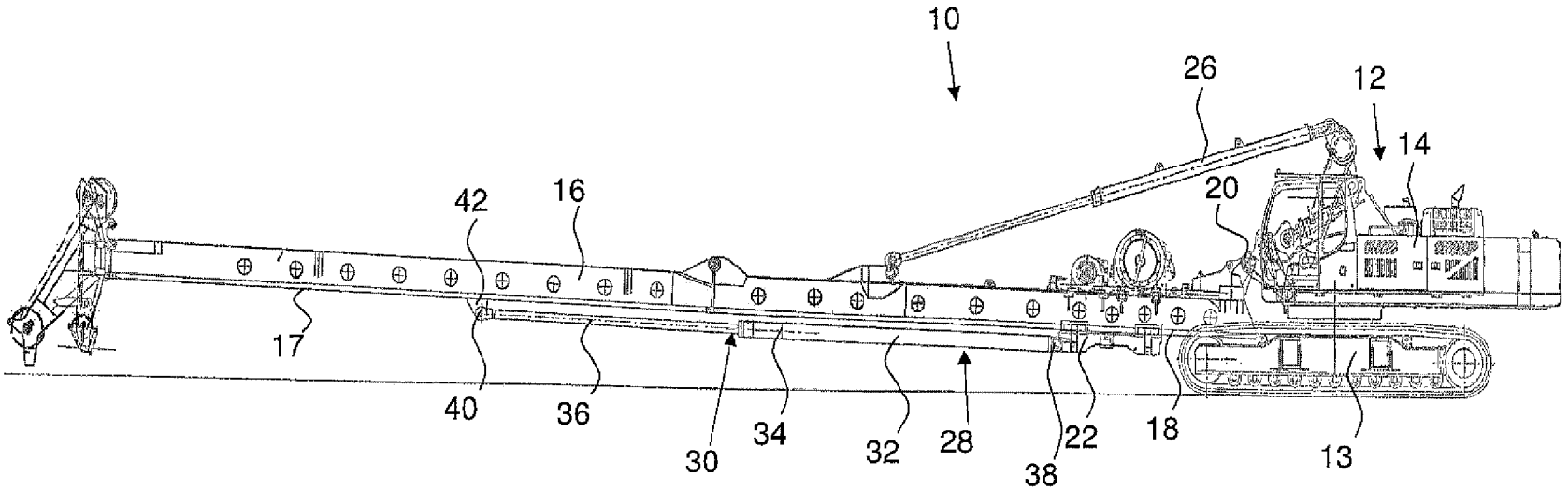
FIG. 1 shows an inventive drilling unit.

FIG. 1 shows an inventive drilling unit 10 with a mast 16 which is in a folded down, approximately horizontal transport position. The drilling unit 10 comprises a carrier vehicle 12 with an undercarriage 13 and an upper structure 14 which is rotationally mounted on the undercarriage 13. The undercarriage 13 can comprise a chassis, in particular a crawler chassis.

The mast 16 is pivotally mounted via a pivot joint 20 on the carrier vehicle 12, in particular on the upper structure 14, and can be pivoted between an approximately horizontal transport position and an approximately vertical operating position.

In order to erect or lower the mast 16 one or more erection cylinders 26 are provided which are fixed on the one hand on the mast 16 and on the other hand on a corresponding connection point on the carrier vehicle 12. The erection cylinder 26 can also be described as a stick cylinder.

On a front side 17 of the mast 16 which forms a lower side in the transport position a carriage 22 is mounted so that it can be displaced longitudinally along a guide means 18. The guide means 18 can in particular comprise a guide rail which is in engagement with guide shoes of the carriage 22.

In order to move the carriage 22 along the mast 16 a carriage drive 28 is provided which comprises a hydraulic cylinder 30 with a cylinder housing 32 and a piston 34 mounted so that it can be displaced therein. The piston 34 is fixed to a piston rod 36, of which the longitudinal axis extends coaxially with the longitudinal axis of the cylinder housing 32.

The piston rod 34 is fixed at an upper connection point 40 on the mast 16. The connection point 40 comprises a pivot joint with a pivot bolt which is mounted on a bearing plate 42 of the mast 16. The cylinder housing 32 is fixed at a lower connection point 38 on the carriage 22. The connection point 38 also comprises a pivot joint with a pivot bolt.

Through the cylinder housing 32 arranged in the lower region of the mast 16 and the piston rod 36 arranged in the upper region of the mast 16 the centre of gravity of the mast 16 is moved downwards so that simpler erection and lowering of the mast can take place by means of the erection cylinder 26.

In order to actuate the hydraulic cylinder 30 the latter is connected to a central hydraulic supply 80. The connection to the central hydraulic supply 80 thereby takes place via a hydraulic connection 50 which is fixedly arranged on the carriage 22 and can be moved with said carriage 22 relative to the mast 22. For this purpose a retaining element 58 or retaining plate is fixed to the side on the carriage 22 and carries the hydraulic connection 50.

The hydraulic cylinder 30 comprises a first, lower connection nozzle 44 which is connected via a first hydraulic line 62 to the hydraulic connection 50. The hydraulic cylinder 30 further comprises a second, upper connection nozzle 46 which is connected via a second hydraulic line 64 to a second hydraulic connection 52 on the carriage 22. The first connection nozzle 44 is line-connected to a first cylinder chamber of the hydraulic cylinder 30 and the second connection nozzle 46 to a second cylinder chamber of the hydraulic cylinder 30.

Furthermore there is at least one further hydraulic connection 54 for a hydraulic motor, for example a rotary drive for a drill rod assembly, on the carriage 22, in particular on the retaining means 58. Both the hydraulic connections 50, 52 for the hydraulic cylinder 30 and also the further hydraulic connection 54 are connected to the central hydraulic supply 80.

The hydraulic connections 50, 52, 54 are arranged on a distribution means 60 which distributes hydraulic fluid from the central hydraulic supply 80 to the hydraulic connections 50, 52, 54. Furthermore there is a return connection 56 on the distribution means 60 for returning hydraulic fluid. The distribution means 60 is fixed to the carriage 22 and can also include the retaining means 58.

Figure 2:
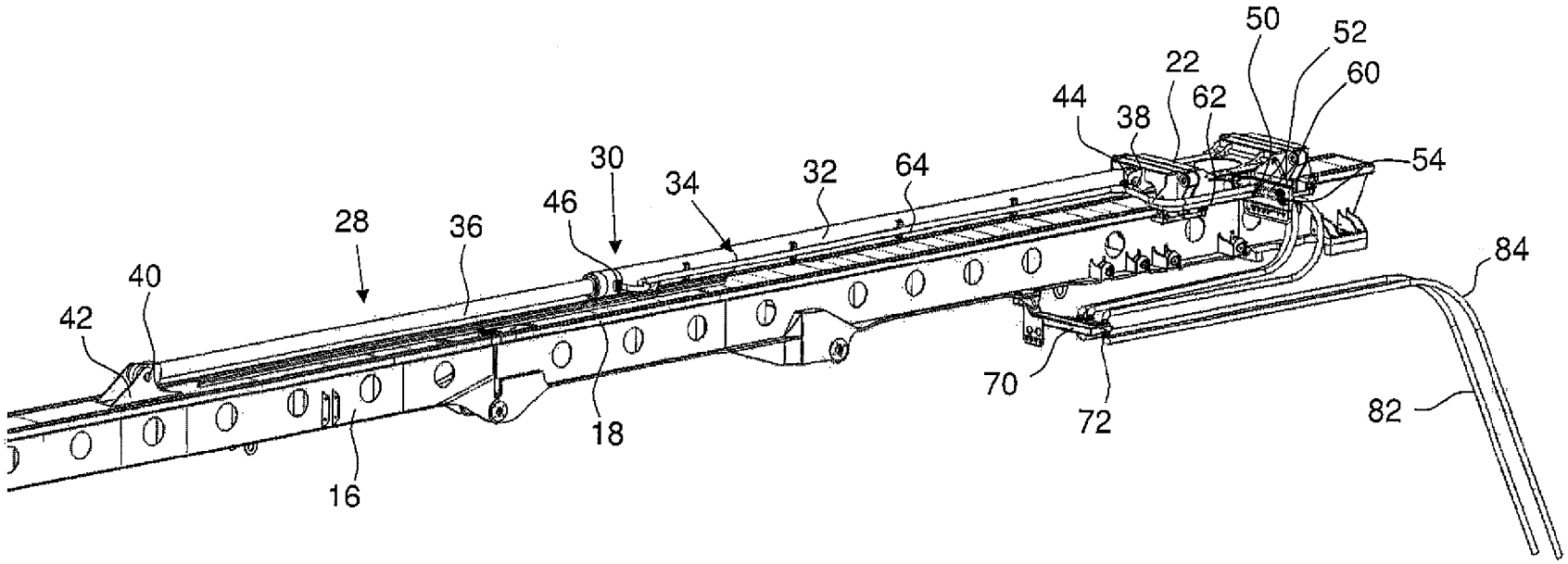
FIG. 2 a lower section of the mast of the drilling unit of FIG. 1.
Figure 3:
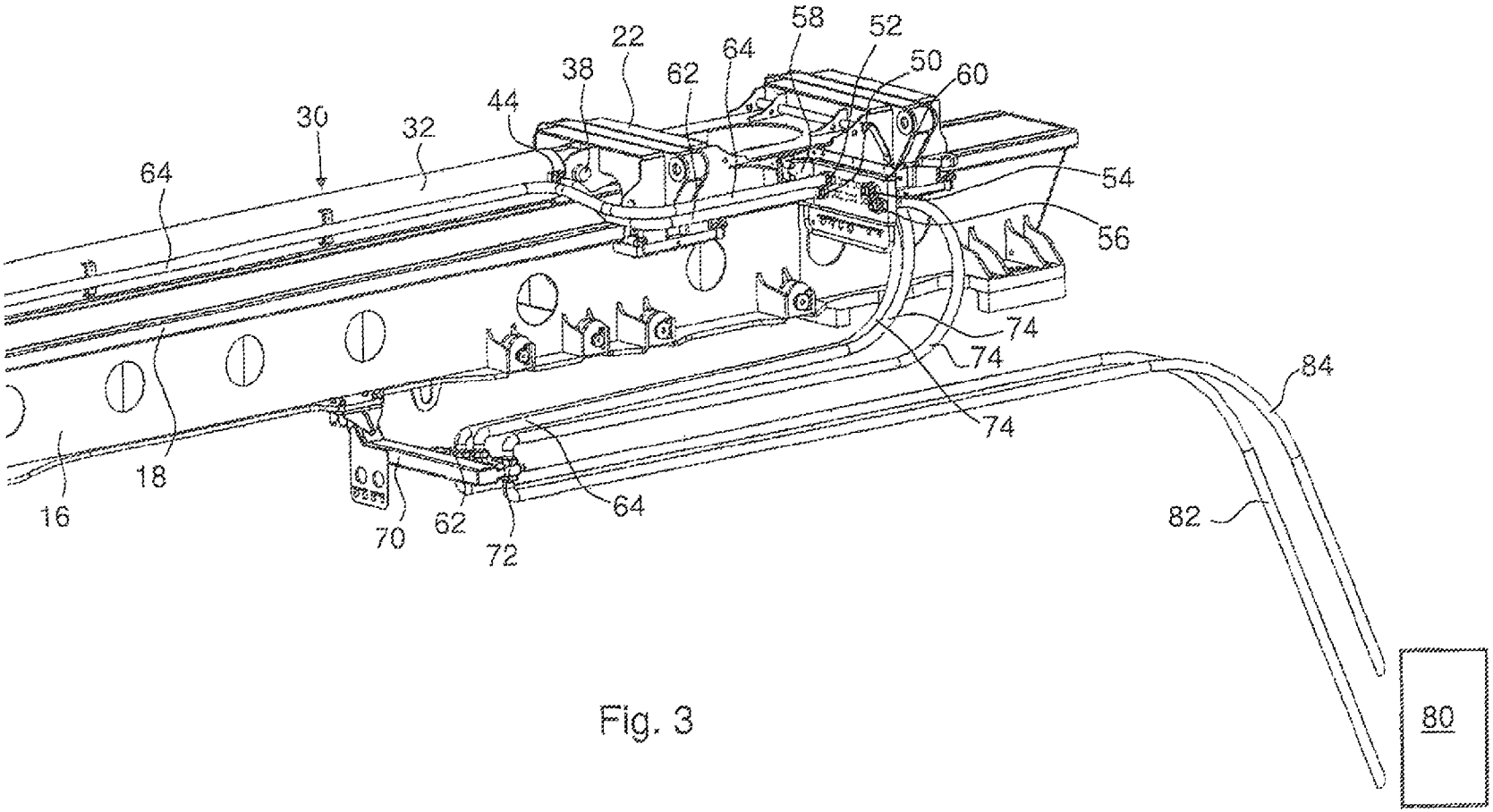
FIG. 3 an enlarged view of FIG. 2.

A retaining element 70 is fixed to the mast 16 approximately half way along the movement path of the carriage 22, whereby a central supply line 82 and a central return line 84 are connected to said retaining element 70. The retaining element 70 can comprise a further distribution means 72, as shown schematically in FIGS. 2 and 3. In particular it can be provided that a distribution means 72 is provided on the mast 16 for distribution of hydraulic fluid between the upper and the lower cylinder chamber of the hydraulic cylinder 30. The corresponding distribution can, however, also take place on the distribution means 60 on the carriage 22. The hydraulic cylinder 30 is thus connected to the central hydraulic supply 80 via a first retaining element 58 fixedly arranged on the carriage 22 and a second retaining means 70 fixedly arranged on the mast 60. Both retaining elements 58, 70 can also be formed as distribution means 60 and 72 respectively.

One or more flexible tube sections 74 for feeding and/or returning hydraulic fluid are provided between the retaining element 70 and the carriage 22, in particular the hydraulic connection 50 and the distribution means 60 respectively. In the embodiment shown according to FIGS. 2 and 3 the flexible tube sections comprise a section of a hydraulic line to the lower cylinder chamber of the hydraulic cylinder 30, a section of a hydraulic line to the upper cylinder chamber of the hydraulic cylinder 30 and a section of a return line. Furthermore line sections can be provided to the at least one further hydraulic connection 54 on the distribution means 60 which are not shown in the drawings. The flexible tube section 74 can also be a part of the central supply line 82 and/or the central return line 84.

All in all a drilling unit is provided according to the invention with a constructively simple carriage drive which additionally facilitates economical erection and lowering of the mast relative to the carrier vehicle.

The invention claimed is:

1. Drilling unit comprising a carrier vehicle with a hydraulic supply, a mast, a carriage being movable along the mast, and a hydraulic cylinder for moving the carriage, the hydraulic cylinder including a cylinder housing, in which a piston with a piston rod is mounted to the mast by a connector so that the piston is displaced, wherein the cylinder housing is fixed to the carriage so as to move with the carriage, a first distributor is directly fixed at least to the carriage, the first distributor is connected to the hydraulic supply via at least one central supply line and a central return line, the first distributor includes at least one hydraulic connection for the hydraulic cylinder and one further hydraulic connection for driving a drive motor on the carriage by the hydraulic supply, whereby a rigid pipeline is provided along the mast between the hydraulic connection on the carriage and the hydraulic cylinder, a retaining element is arranged on the mast, a second distributor is arranged on the retaining element, the at least one central supply line and the central return line are connected to the first distributor via the second distributor, a flexible hydraulic tubing is provided, connecting the second distributor and the first distributor for moving of one end of the flexible hydraulic tubing with the carriage along the mast, and the hydraulic cylinder is connected via the at least one hydraulic connection for the hydraulic cylinder from the first distributor via the second distributor on the retaining element to the hydraulic supply.

2. Drilling unit according to claim 1, wherein the hydraulic cylinder is a double acting cylinder with two cylinder chambers, and two hydraulic connections are provided on the carriage, wherein a first cylinder chamber of the hydraulic cylinder is line-connected to a first hydraulic connection and a second cylinder chamber is line-connected to a second hydraulic connection.

3. Drilling unit according to claim 1, wherein at least one hydraulic line is arranged between the at least one hydraulic connection for the hydraulic cylinder and the hydraulic cylinder, said at least one hydraulic line extending from the at least one hydraulic connection for the hydraulic cylinder upwards along the mast.

4. Drilling unit according to claim 1, wherein a fixed pipeline is provided between the at least one hydraulic connection for the hydraulic cylinder on the carriage and the hydraulic cylinder.

5. Drilling unit according to claim 1, wherein at least one central supply line is arranged between the at least one hydraulic connection for the hydraulic cylinder and the at least one hydraulic supply, said at least one central supply line is fixed to said retaining element on the mast.

6. Drilling unit according to claim 5, wherein the retaining element is arranged centrally on the mast in relation to the cylinder housing of the hydraulic cylinder.

* * * * *